US005355547A

United States Patent [19]

Fitjer

[11] Patent Number: 5,355,547

[45] Date of Patent: Oct. 18, 1994

[54] DENTAL CLEANING BRUSH

[75] Inventor: Holger Fitjer, Ansbach, Fed. Rep. of Germany

[73] Assignee: Georg Karl Geka-Brush GmbH, Bechhofen-Walzendorf, Fed. Rep. of Germany

[21] Appl. No.: 22,126

[22] Filed: Feb. 25, 1993

[30] Foreign Application Priority Data

Feb. 27, 1992 [DE] Fed. Rep. of Germany ..... 9202508

[51] Int. Cl.[5] ..... A46B 3/18

[52] U.S. Cl. ..... 15/206; 15/167.1

[58] Field of Search ..... 15/167.1, 206, 207, 15/207.2, 164, 160, 159.1, 143.1, 104.02, 104.03, 104.05, 189, 195, 199; 401/268, 118; 300/21

[56] References Cited

U.S. PATENT DOCUMENTS

| | | | |
|---|---|---|---|
| 832,498 | 10/1906 | McHenry | 15/159.1 |
| 2,584,503 | 2/1952 | Schleenbaker | 15/164 |
| 2,869,160 | 1/1959 | Murcott | 15/164 |
| 2,972,157 | 2/1961 | Peterson | 15/206 |
| 3,124,823 | 3/1964 | Charvat | 15/207.2 |
| 3,720,975 | 3/1973 | Nelson | 15/206 |
| 4,108,162 | 8/1978 | Chikashige et al. | 15/206 |
| 4,691,404 | 9/1987 | Tarrson et al. | 15/206 |
| 4,710,996 | 12/1987 | Tarrson et al. | 15/206 |
| 4,733,425 | 3/1988 | Hartel et al. | 15/207.2 |
| 4,759,376 | 7/1988 | Stormby | 15/206 |
| 4,819,291 | 4/1989 | Gunjian | 15/206 |
| 4,927,281 | 5/1990 | Gueret | 15/207.2 |
| 5,067,195 | 11/1991 | Sussman | 15/206 |
| 5,133,590 | 7/1992 | Fitjer | 15/206 |

FOREIGN PATENT DOCUMENTS

| | | | |
|---|---|---|---|
| 725480 | 9/1942 | Fed. Rep. of Germany | 15/206 |
| 1934468 | 1/1971 | Fed. Rep. of Germany | 15/206 |
| 3128749 | 5/1982 | Fed. Rep. of Germany . | |
| 13690 | 6/1993 | PCT Int'l Appl. | 15/160 |
| 791497 | 3/1958 | United Kingdom | 15/206 |
| 2085718 | 5/1982 | United Kingdom | 15/207 |
| 2239168 | 6/1991 | United Kingdom | 401/268 |

*Primary Examiner*—David A. Scherbel
*Assistant Examiner*—Tony G. Soohoo
*Attorney, Agent, or Firm*—Browdy and Neimark

[57] ABSTRACT

A dental cleaning brush, in particular an interdental brush, comprising a plurality of fiber portions retained between two twisted wire sections and extending away from the latter, has at least a certain part of the fiber portions formed such that they extend approximately in the longitudinal direction of the wire sections or the brush core, respectively, in order that painful galvanic effects during the use be avoided.

2 Claims, 1 Drawing Sheet

DENTAL CLEANING BRUSH

FIELD OF THE INVENTION

The invention relates to a dental cleaning brush, in particular an interdental brush, comprising a plurality of fiber portions retained between two twisted wire sections and extending away from the latter.

BACKGROUND OF THE INVENTION

A brush of the generic type is known for instance from DE 31 28 749 A1. This publication also describes the problem that any direct contact of the metal wire sections with paradontous tooth-necks or fillings and bridges may generate painful galvanic effects.

For the solution of this problem, in the known interdental toothbrush provision is made for the wire sections of steel wire to be surrounded by an electrically insulating layer, which may consist of a flexible and non-abrasive material such as for instance nylon or polyurethane. It is provided that this layer can be applied as a varnishing by dipping or spraying or that it coats the wire in the form of a hose.

If such a coating is to be applied as such after the manufacture of the brush, this is only feasible with comparatively expensive manufacturing techniques and the individual bristles must moreover have a comparatively large distance one from the other. If, prior to being twisted, the wire is provided or coated with the plastic layer, then there is the risk that the layer cracks as a result of the twisting and also the engagement of the wire with the fiber portions is affected by the plastic coating, so that it is not possible, at least not without any difficulties, to produce the desired distribution of the tips. Moreover, such a coating will inevitably increase the effective thickness of the twisted central portion of the brush, so that the brush can no longer enter into narrow tooth gaps to the extent desired.

SUMMARY OF THE INVENTION

It is accordingly an object of the invention to embody a dental cleaning brush of the above generic type, which can be manufactured efficiently and consequently at a low cost, in which the problem of galvanic effects resulting from the direct contact of the sections is substantially reduced, and which additionally shows a distribution of the fiber portions such that fibers extend away from the twisted wires virtually into all directions thus assuring an extensive cleaning effect.

In accordance with the invention this object is attained in that each individual fiber portion consists of a plurality of fiber-segment portions, these fiber-segment portions extending away from where they are retained between the wire sections while fanning out in tufts, and part of the fibers also extending approximately in the longitudinal direction of the wire sections.

This is advantageously attained in that the fiber-segment portions are glued together where they are retained between the wire sections by means of a glue soluble in a solvent that does not attack the fiber portions themselves.

Such fibers are commercially available and their use in gynecological brushes or mascara brushes is known per se. The advantage of these fibers resides in that, in their original bound condition, they are proportioned for easy processing in commonly used machines, the bond of the fiber segments being dissolved by a corresponding solvent only after the individual brush is finished and only the part between the twisted wire sections that is not reached by the solvent remaining glued together.

In combination with a wire diameter of maximally 0.5 mm, preferably 0.1 to 0.25 mm, this leads to a configuration, in which, starting in each case from a point between the twisted wires, the fiber-segment portions extend in the form of a cone of an angle of spread of almost 180°.

Correspondingly, part of the fibers also extend along the wire sections protecting the latter from directly contacting for instance fillings. Furthermore, the fiber-segment portions have a very uniform distribution so that all parts of the teeth are reached.

The fiber-free end of the wire sections may be glued in known manner into a plastic holding device, which is in turn replaceably attachable to a handle.

In an alternative of this, the fiber-free end of the wire sections can be bent over to form a securing ring. This securing ring can be put around a retaining pin with a corresponding arresting mechanism on a handle.

Further details of the invention will become apparent from the ensuing description of preferred exemplary embodiments taken in conjunction with the drawing.

DESCRIPTION OF THE PREFERRED EMBODIMENTS

Figure 1:
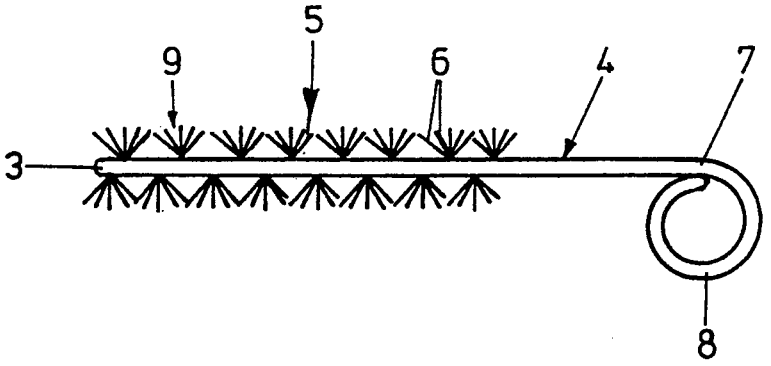
FIG. 1 is a diagrammatic illustration of a dental cleaning brush according to the invention.
Figure 2:
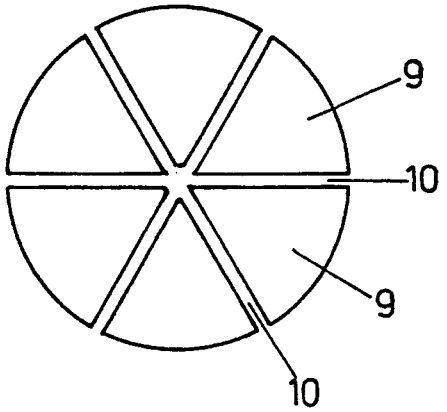
FIG. 2 is a diagrammatic section through a fiber used according to the invention.

A dental cleaning brush shown in the drawing comprises two wire sections 1, 2, which are formed by a wire 4 bent over in the vicinity of the tip 3, the wire sections 1, 2 being twisted one in relation to the other.

The brush portion 5 is provided with fibers 6, whereas the end 7 facing away from the free end 3 is bent over and forms a securing eye 8.

The fibers or fiber portions 6 used consist of a plurality of fiber-segment portions 9, which are glued together by glue layers 10. Fibers of this type, consisting for instance of three or six segments, are commercially available.

The formation of the brush portion 5 takes place in known manner in that the fibers 6 are placed in between the wire sections 1, 2, whereupon the wire sections are twisted. After the twisting the dental cleaning brush thus formed is put into a solvent, by which the glue layers 10 are dissolved wherever the solvent reaches the glue layers 10.

Figure 3:
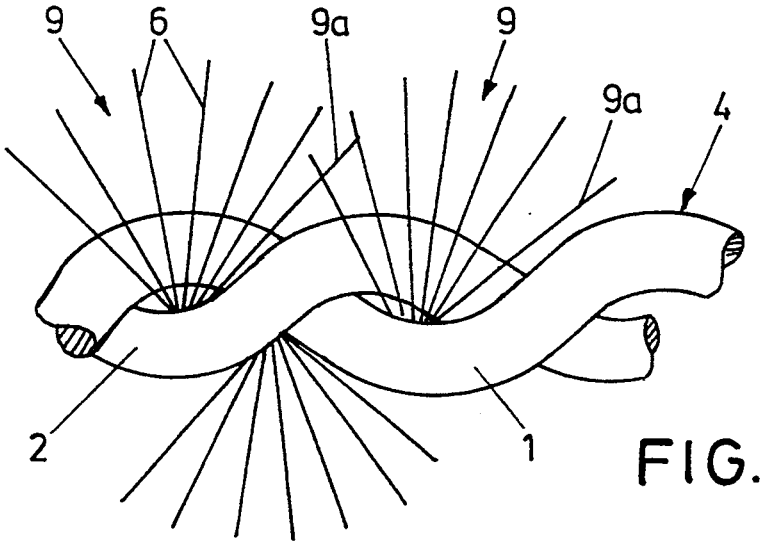
FIG. 3 is a diagrammatic, perspective view to illustrate the fiber configuration.

By reason of this dissolving process on the one hand and by reason of the forces caused by the very thin wire 4 and acting on the foot of the fiber-segment portions 9, an extraordinarily strong fanning out effect is achieved as diagrammatically shown in FIG. 3, so that the fiber-segment portions 9 extend away from their base point in tile form of a cone, whereupon part of the fiber-segment portions **9*a* take a place more or less in parallel to the wire sections 1, 2, so that these fiber-segment portions 9*a*** form a kind of an insulating protecting jacket.

What is claimed:

1. An interdental brush, comprising a plurality of fiber portions retained between two twisted wire sections and extending away from the latter, wherein the diameter of the wire sections (1,2) is in the range of 0.1 to 0.25 mm, wherein each individual fiber portion 96) consists of a plurality of fiber-segment portions (9), the fiber-segment portions (9) extending away from where they are retained between the wire sections (1,2) while fanning out in tufts, and part of the fiber portions (9) also extending approximately in the longitudinal direction of the wire sections (1,2), and wherein only the fiber-segment portions (9) are glued together where they are retained between the wire sections (1,2) by means of a glue (10) soluble in a solvent that does not attack the fiber-segment portions (9).

2. A dental cleaning brush according to claim 1, wherein the fiber-free end (7) of the wire sections (1,2) is bent over to form a securing eye (8).

* * * * *